US011187116B2

(12) United States Patent
Izawa

(10) Patent No.: US 11,187,116 B2
(45) Date of Patent: Nov. 30, 2021

(54) SLIDING MEMBER, AND SLIDING MEMBER OF INTERNAL COMBUSTION ENGINE

(71) Applicant: Nissan Motor Co., Ltd., Yokohama (JP)

(72) Inventor: Yoshinori Izawa, Kanagawa (JP)

(73) Assignee: NISSAN MOTOR CO., LTD., Yokohama (JP)

( * ) Notice: Subject to any disclaimer, the term of this patent is extended or adjusted under 35 U.S.C. 154(b) by 0 days.

(21) Appl. No.: 16/483,354

(22) PCT Filed: Feb. 2, 2018

(86) PCT No.: PCT/IB2018/000177

§ 371 (c)(1),
(2) Date: Aug. 2, 2019

(87) PCT Pub. No.: WO2018/142225

PCT Pub. Date: Aug. 9, 2018

(65) Prior Publication Data

US 2020/0011216 A1 Jan. 9, 2020

(30) Foreign Application Priority Data

Feb. 3, 2017 (JP) ..... JP2017-018618

(51) Int. Cl.
*F01L 3/04* (2006.01)
*F01L 3/08* (2006.01)
*C23C 24/04* (2006.01)

(52) U.S. Cl.
CPC ..... *F01L 3/04* (2013.01); *F01L 3/08* (2013.01); *C23C 24/04* (2013.01)

(58) Field of Classification Search
None
See application file for complete search history.

(56) References Cited

U.S. PATENT DOCUMENTS

2012/0128284 A1 5/2012 Mordente
2013/0095250 A1 4/2013 Sato

FOREIGN PATENT DOCUMENTS

CN 101285187 A 10/2008
CN 104561991 A 4/2015
(Continued)

OTHER PUBLICATIONS

English translation of JP H08-253856A by from EPO dated Oct. 1, 2020 (18 pages) (Year: 2020).*
(Continued)

*Primary Examiner* — Adam Krupicka
(74) *Attorney, Agent, or Firm* — Foley & Lardner LLP

(57) ABSTRACT

A sliding member includes a base substrate and a coating layer formed on the base substrate. The coating layer includes an inorganic part derived from at least one type of inorganic particles selected from the group consisting of iron base alloy particles, cobalt base alloy particles, chromium base alloy particles, nickel base alloy particles, molybdenum base alloy particles, and ceramic particles, and a metal part derived from at least one type of metal particles selected from the group consisting of iron base alloy particles other than listed in the above group, copper particles, and copper alloy particles. The inorganic part is bonded to another inorganic part and/or the metal part via interfaces therebetween, and the metal part is bonded to another metal part and/or the inorganic part via interfaces therebetween. The sliding member includes an interface layer including at least one of a diffusion layer and an intermetallic compound layer on at least one part of an interface between the base substrate and the coating layer or interfaces between the inorganic part and the metal part, the inorganic parts, and the metal parts. The interface layer has a thickness of equal to or less than 2 μm.

10 Claims, 11 Drawing Sheets

(56) References Cited

FOREIGN PATENT DOCUMENTS

| | | | |
|---|---|---|---|
| EP | 3 333 283 | A1 | 6/2018 |
| JP | 60-166443 | U | 11/1985 |
| JP | S60-262954 | A | 12/1985 |
| JP | 61-179856 | A | 8/1986 |
| JP | H02-228462 | A | 9/1990 |
| JP | H06-179937 | A | 6/1994 |
| JP | 08-052535 | A | 2/1996 |
| JP | H08-253856 | A | 10/1996 |
| JP | 2000-170601 | A | 6/2000 |
| JP | 2000-199045 | A | 7/2000 |
| JP | 2002-086248 | A | 3/2002 |
| JP | 2005-179707 | A | 7/2005 |
| JP | 2007-270206 | A | 10/2007 |
| JP | 2011-050888 | A | 3/2011 |
| JP | 2012-012686 | A | 1/2012 |
| JP | 2012-218016 | A | 11/2012 |
| JP | 2012-530227 | A | 11/2012 |
| JP | 2013-147717 | A | 8/2013 |
| JP | 2014-009390 | A | 1/2014 |
| JP | 2015-096709 | A | 5/2015 |
| JP | 6006846 | B1 | 10/2016 |
| JP | 2017-036464 | A | 2/2017 |

OTHER PUBLICATIONS

English translation of JP3460968B2 from Google Patents dated Sep. 30, 2020 (14 pages) (Year: 2020).*
International Preliminary Report on Patentability and English translation, PCT/IB2018/000177, dated Aug. 22, 2019, 13 pages.

* cited by examiner

SLIDING MEMBER, AND SLIDING MEMBER OF INTERNAL COMBUSTION ENGINE

TECHNICAL FIELD

The present invention relates to a sliding member, and to a sliding member of an internal combustion engine.

BACKGROUND ART

In the prior art, a sintered alloy for a valve seat has been proposed whose wear resistance is excellent and whose aggressiveness against an opposing member is low (refer to Patent Document 1). In this sintered alloy for a valve seat, hard alloy particles (A) having hardness 500 HV to 900 HV, hard alloy particles (B) having hardness 1000 HV or greater, ceramic particles (C) having hardness 1500 HV or greater, and $CaF_2$ particles (D) are dispersed in the proportions of 20 to 30 weight percent (A), 1 to 10 weight percent (B), 1 to 10 weight percent (C), and 0.5 to 7 weight percent (D) (where A+B+C is less than 40 weight percentage) into a sintered alloy skeleton matrix consisting of 1.0 to 1.3 weight percent carbon and 1.5 to 3.4 weight percent chromium with remainder iron and inevitable impurities, and moreover this sintered alloy is particularly characterized in that copper or a copper alloy is infiltrated to 10 to 20 weight percent into vacant cavities in that skeleton.

CITATION LIST

Patent Literature

Patent Document 1: Japanese Laid-Open Patent Publication Heisei 6-179937.

SUMMARY OF INVENTION

Technical Problem

However, with the sintered alloy for a valve seat described in Patent Document 1, there is room for improvement in relation to the wear resistance.

The present invention has been made in the light of this type of problem with the prior art. And the object of the present invention is to provide a sliding member and a sliding member of an internal combustion engine that are capable of implementing excellent wear resistance and excellent thermal conductivity.

Solution to Technical Problem

The present inventor has conducted extensive investigation in order to attain the objective described above. And, as a result, the present inventor has succeeded in completing the present invention with the realization that it is possible to attain the objective described above by forming, upon a base substrate, a coating layer including a predetermined inorganic portion and a predetermined metal portion, or including a predetermined hard material portion and a predetermined soft material portion.

Advantageous Effects of Invention

According to the present invention, it is possible to provide a sliding member, and a sliding member of an internal combustion engine, that are capable of implementing excellent wear resistance and excellent thermal conductivity.

DESCRIPTION OF EMBODIMENTS

Figure 1:
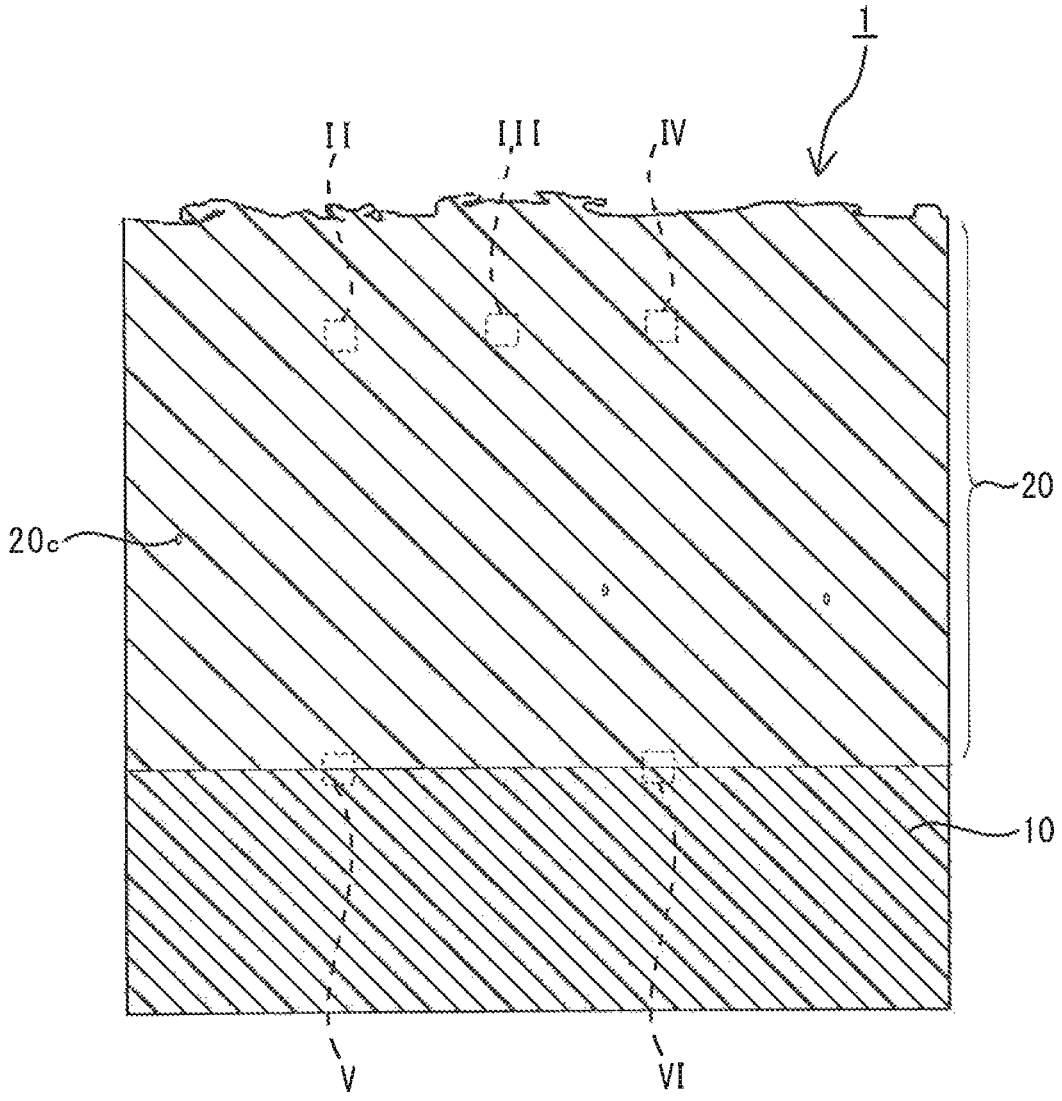
FIG. 1 is a schematic view showing a section of a sliding member according to a first embodiment of the present invention.

A sliding member and a sliding member of an internal combustion engine according to one embodiment of the present invention will now be explained in detail in the following.

1st Embodiment

First, a sliding member according to a first embodiment of the present invention will be explained in detail with reference to the drawings. It should be understood that, in some cases, the ratios of the dimensions in the drawings referred to in the following embodiments may be exaggerated for the convenience of explanation, and accordingly may be different from the actual ratios.

Figure 2:
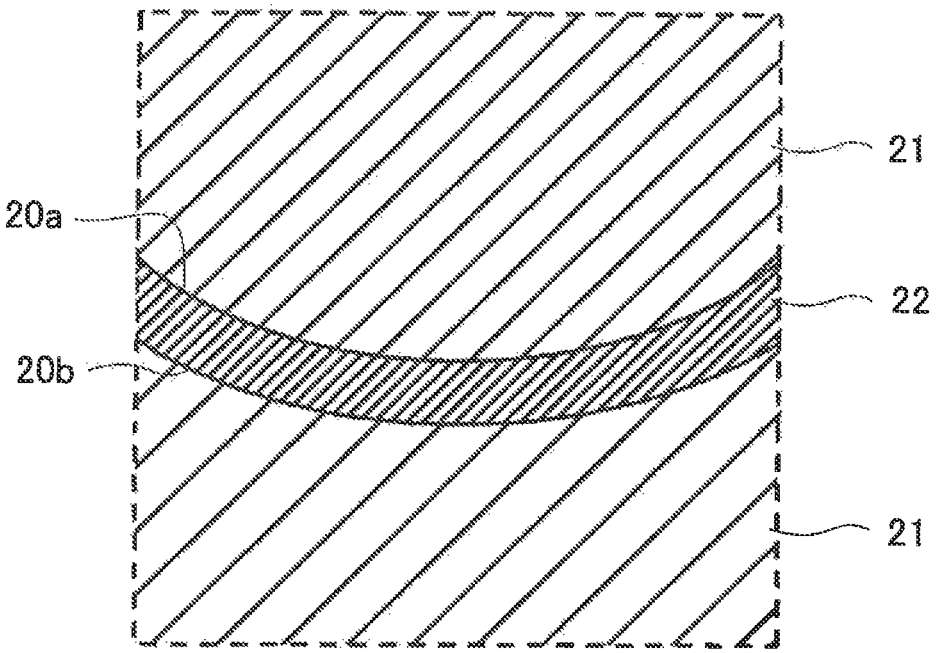
FIG. 2 is an enlarged view of a portion of the sliding member shown in FIG. 1 surrounded by a line II.
Figure 3:
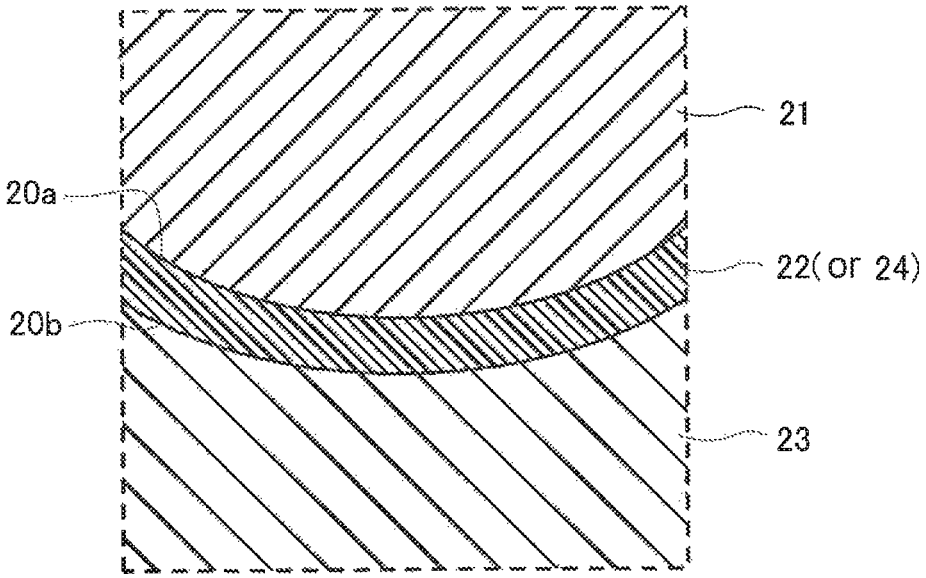
FIG. 3 is an enlarged view of a portion of the sliding member shown in FIG. 1 surrounded by a line III.
Figure 4:
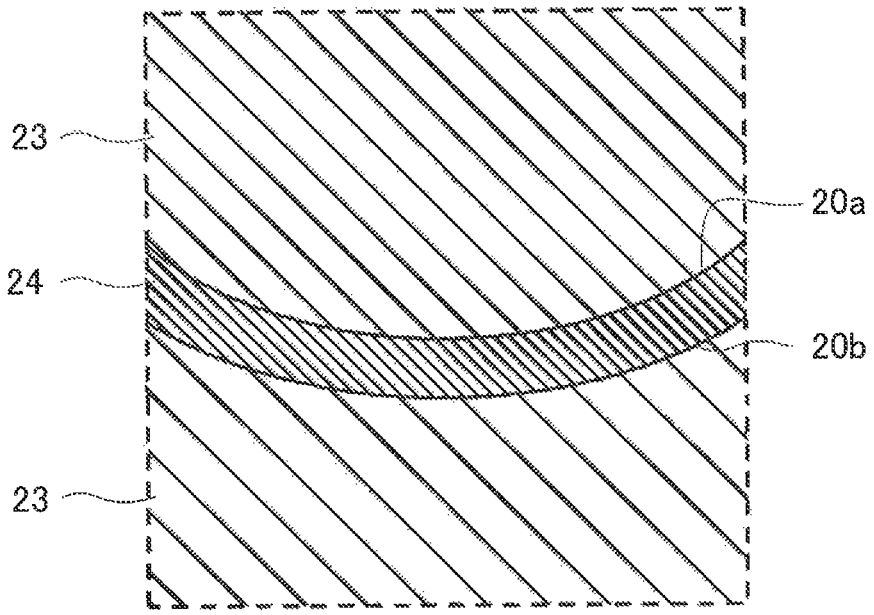
FIG. 4 is an enlarged view of a portion of the sliding member shown in FIG. 1 surrounded by a line IV.
Figure 5:
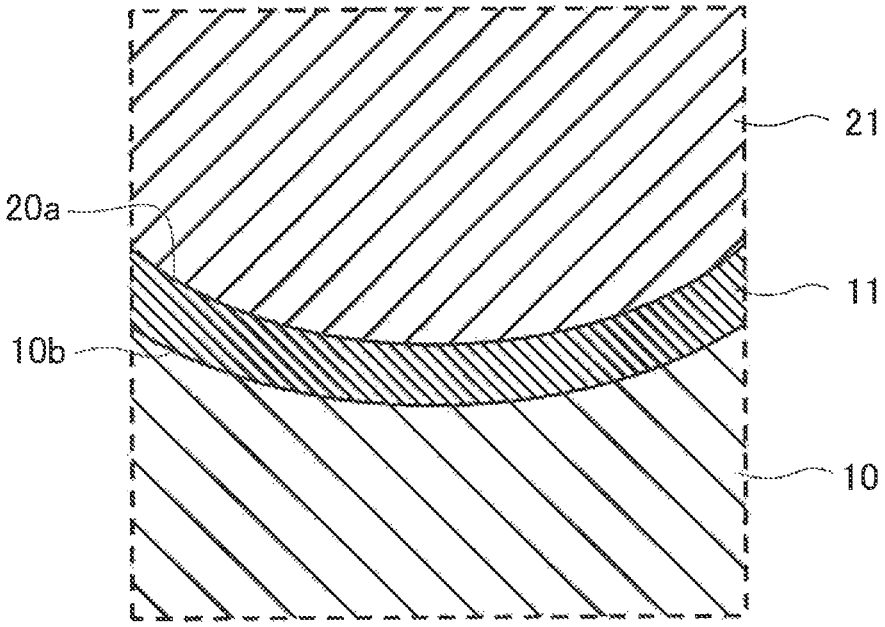
FIG. 5 is an enlarged view of a portion of the sliding member shown in FIG. 1 surrounded by a line V.
Figure 6:
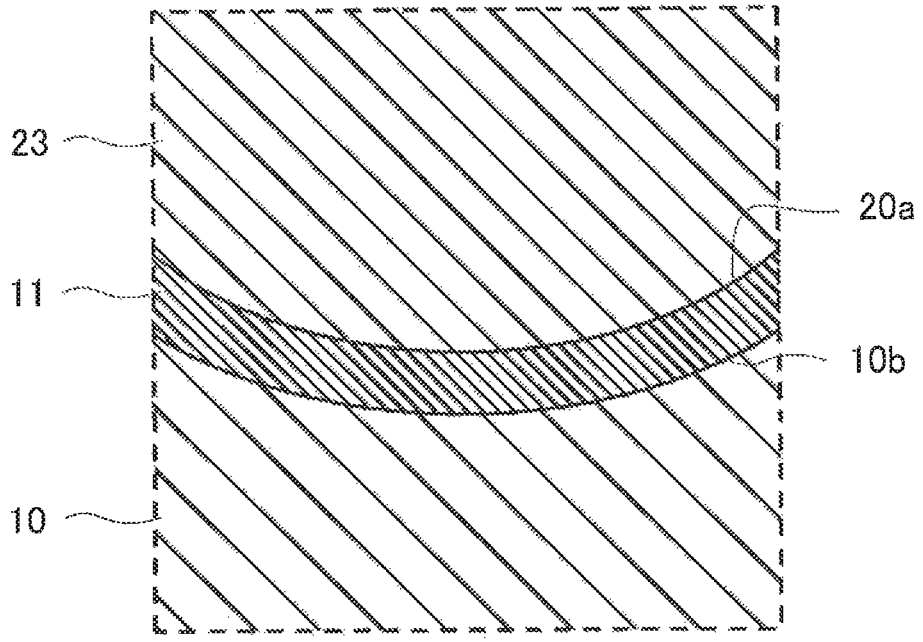
FIG. 6 is an enlarged view of a portion of the sliding member shown in FIG. 1 surrounded by a line VI.

FIG. 1 is a schematic view showing a section of a sliding member according to the first embodiment of the present invention. Moreover, FIG. 2 is an enlarged view of a portion of the sliding member shown in FIG. 1 surrounded by a line II. And FIG. 3 is an enlarged view of a portion of the sliding member shown in FIG. 1 surrounded by a line III. Furthermore, FIG. 4 is an enlarged view of a portion of the sliding member shown in FIG. 1 surrounded by a line IV. Yet further, FIG. 5 is an enlarged view of a portion of the sliding member shown in FIG. 1 surrounded by a line V. And FIG. 6 is an enlarged view of a portion of the sliding member shown in FIG. 1 surrounded by a line VI.

As shown in FIG. 1 to FIG. 6, a sliding member 1 of this embodiment comprises a base substrate 10 and a coating layer 20 formed upon the base substrate 10. And the coating layer 20 comprises at least one predetermined inorganic portion 21 and at least one predetermined metal portion 23. Moreover, in the coating layer 20, these portions (for example, two of the inorganic portions 21, 21 or an inorganic portion 21 and a metal portion 23, or two of the metal portions 23, 23) are bonded together via the interface. It should be understood that the coating layer 20 may also include pores 20*c*, although this is not to be considered as being particularly limitative.

And, as shown in FIG. 2 to FIG. 6, at the interface between the base substrate 10 and the coating layer 20, and at the interface between the portions (for example, between two of the inorganic portions 21, 21, or between an inorganic portion 21 and a metal portion 23, or between two of the metal portions 23, 23), this sliding member 1 comprises interface layers 11, 22 and 24 that include at least one of a diffusion layer and an intermetallic compound layer on at least one portion of one of those interfaces. In other words, it would be possible for such an interface layer to be the interface between an inorganic portion or a metal portion and the base substrate, or the interface between two inorganic portions, or the interface between an inorganic portion and a metal portion, or the interface between two metal portions, or the like. The thickness of this interface layer is 2 μm or less.

Here, the predetermined inorganic portion is a material derived from at least one type of inorganic particles selected from the group consisting of iron base alloy particles, cobalt base alloy particles, chromium base alloy particles, nickel base alloy particles, molybdenum base alloy particles, and ceramic particles.

And the predetermined metal portion is a material derived from at least one type of metal particles selected from the group consisting of iron base alloy particles other than listed in the above group, copper particles, and copper alloy particles.

And, although this is not to be considered as being particularly limitative, as shown in FIGS. 5 and 6, the base substrate 10 includes a plastically deformed portion 10*b* that consists of a flattened concave portion. Although this feature is not shown in the figures, it should be understood that it goes without saying that a case in which the base substrate does not include any such plastically deformed portion consisting of a flattened concave portion is also included within the scope of the present invention.

Moreover, although this is not to be considered as being particularly limitative, as shown in FIG. 2 to FIG. 6, the coating layer 20 includes a plastically deformed portion 20*a* having a structure in which a metal portion 23 and an inorganic portion 21 having a flattened shape are accumulated. Although this feature is not shown in the figures, it should be understood that it goes without saying that a case in which the coating layer does not include any such plastically deformed portion having a structure in which either or both of a metal portion and an inorganic portion having a flattened shape are accumulated is also included within the scope of the present invention.

Furthermore, although this is not to be considered as being particularly limitative, as shown in FIG. 2 to FIG. 4, the coating layer 20 includes a plastically deformed portion 20*b* consisting of a metal portion 23 and an inorganic portion 21 formed as a flattened concave portion, and a plastically deformed portion 20*a* having a structure in which a metal portion 23 and an inorganic portion 21 having a flattened shape are accumulated. Although this feature is not shown in the figures, it should be understood that it goes without saying that a case in which the coating layer does not include any such plastically deformed portion consisting of a metal portion and an inorganic portion formed as a flattened concave portion, and/or does not include any such plastically deformed portion having a structure in which a metal portion and an inorganic portion having a flattened shape are accumulated, is also included within the scope of the present invention.

Since, as described above, the sliding member of this embodiment is a sliding member comprising a base substrate and a coating layer formed upon that base substrate, with the coating layer comprising the predetermined inorganic portion and the predetermined metal portion and with these two portions being bonded together via the interface, and having an interface layer that includes at least one of a diffusion layer and an intermetallic compound layer on at least one portion of one of the interface between the base substrate and the coating layer, and the interface between the above described portions, and in which the thickness of the interface layer is 2 μm or less, accordingly it has excellent wear resistance and excellent thermal conductivity.

In other words, as compared with a sliding member having a coating layer obtained by performing sintering processing, the sliding member of this embodiment has excellent wear resistance and excellent thermal conductivity. And, as compared with a sliding member having a coating layer obtained by performing sintering processing, the sliding member of this embodiment has excellent wear resistance and excellent thermal conductivity even if the proportional content of the inorganic portion is relatively low. Moreover, even with a coating layer having an inorganic portion and/or a metal portion whose thermal conductivity is not high, since the thickness of each of the interface layers is 2 μm or less, accordingly it becomes possible to suppress or to prevent deterioration of the thermal conductivity, so that this sliding member has excellent wear resistance and excellent thermal conductivity.

On the other hand, the desired beneficial effect cannot be achieved when the thickness of at least one of the interface layers is greater than 2 μm, since a component included in the inorganic portion diffuses into the base substrate or into the metal portion preferably serving as a base material or the like. It should be understood that, in consideration of the limitation at the present point in time for detection of the interface layer by transmission electronic microscopy (TEM) sectional imaging or by energy dispersive X-ray (EDX) analysis, the lower limit for the thickness of the interface layer is around 30 nm. Moreover, although this is not to be considered as being particularly limitative, the thickness of the interface layer is desirably 1 μm or less, and more desirably is 0.5 μm or less. And furthermore, although this is not to be considered as being particularly limitative, the thickness of the interface layer is desirably 0.03 μm or greater, and more desirably is 0.05 μm or greater, and even more desirably is 0.1 μm or greater.

Yet further, in this sliding member, it is desirable for at least one of the base substrate and the coating layer to include at least one plastically deformed portion. Due to this, it is possible to implement wear resistance and thermal conductivity that are yet more excellent.

At the present point in time, it is considered that the beneficial effects described above are obtained due to at least one of the following reasons.

For example, when spraying onto the base substrate the inorganic particles or the metal particles described above, which are some of the raw materials used in the method for manufacturing this sliding member, a part of their kinetic energy is converted into thermal energy, and deposition or atomic diffusion between the inorganic particles or the metal particles and the base substrate takes place in an extremely short time period as compared to the case during sintering processing. Furthermore, in some cases, deposition or atomic diffusion also takes place between the inorganic particles or the metal particles and the inorganic portion or the metal portion that is adhered to the base substrate in an extremely short time period as compared to the case during sintering processing. Yet further, heat is generated when the inorganic particles or the metal particles collide with the base substrate or with the inorganic portion or the metal portion that is adhered to the base substrate and plastic deformation takes place, so that sometimes deposition or atomic diffusion occurs. It is considered that the above described beneficial effects can be ascribed to the fact that, due to the above described phenomena, the adhesion between the inorganic portion and/or the metal portion and the base substrate, and/or the adhesion between the portions such as the inorganic portion and the metal portion and so on, is improved. To put it in another manner, it is considered that this is also because the adhesion between the inorganic portion or the metal portion and the base substrate, and/or the adhesion between the inorganic portion and the metal portion and so on, is enhanced by the formation of an interface layer whose thickness is 2 μm or less and that has at least one of a diffusion layer and an intermetallic compound layer at least on a portion of at least one of the interface between the base substrate and the coating layer and the interfaces between the various portions.

Furthermore, it is considered that the above described beneficial effects can be ascribed to the fact that, when for example inorganic particles or metal particles as described above are sprayed upon the base substrate, as a result of an anchoring effect due to the inorganic particles or metal particles sinking into the base substrate or into an inorganic portion or a metal portion that is adhered to the base substrate, the adhesion between the inorganic portion or metal portion and the base substrate and/or the adhesion between the various portions such as the inorganic portion or the metal portion or the like is enhanced. To put it in another manner, it is considered that the above described beneficial effects may be due to the fact that the adhesion between the inorganic portion or the metal portion and the base substrate, or the adhesion between the various portions such as the inorganic portion or the metal portion and so on, is enhanced due to the formation of at least one plastically deformed portion.

Moreover, it is also considered that the above described beneficial effects can be ascribed to the fact that, when for example inorganic particles and metal particles as described above are sprayed upon the base substrate, if, for example the base substrate had an oxidized layer on its surface that would have impeded the adhesion between the base substrate and the coating layer, then this oxidized layer is removed by the inorganic particles or the metal particles, so that a newly generated interface whose adhesion to the coating layer is excellent is formed upon the base substrate and is exposed.

However, it goes without saying that, even if beneficial effects such as described above are obtained due to reasons other than those described above, this still comes within the scope of the present invention.

It should be understood that, in the present invention, the expression "the portions are bonded together via an interface" means that at least one of deposition, atomic diffusion, sinking in (penetration) and formation of a plastically deformed portion occurs among those portions.

Now, the various components will be further explained in more detail.

Although this is not to be considered as being particularly limitative, for the base substrate described above, a metal material is preferred that can be applied in a method for manufacturing a sliding member that will be described in detail hereinafter, in other words in a method for formation of a coating layer. Moreover, if the sliding member is to be employed as a sliding member of an internal combustion engine, it goes without saying that, for the base substrate, a material is preferred that can be employed in a high temperature environment such as that in which such a sliding member will be applied.

And, as the metal material, for example, it is preferred to apply a per se known prior art alloy of aluminum or iron, titanium, copper, or the like.

For example, as such an aluminum alloy, it is preferred to apply AC2A, AC8A, ADC12 or the like as specified in a Japanese Industrial Standard material. Moreover, as such an iron alloy, for example, it is preferred to apply SUS304 as specified in Japanese Industrial Standard, an iron based sintered alloy or the like. Furthermore, as such a copper alloy, for example, it is preferred to apply a beryllium-copper or copper based sintered alloy or the like.

Furthermore, with regard to the porosity of the coating layer described above, this should not be considered as being particularly limited. For example, it is preferable for the porosity of the coating layer to be as small as possible, from the standpoint that, if the porosity of the coating layer is high, its strength will be insufficient and its wear resistance and thermal conductivity will be deteriorated. And, from the standpoint of it being possible to produce a sliding member having high thermal conductivity, it is preferable for the area cross sectional porosity of the coating layer to be 3% or less, and more preferable for it to be 1% or less, and even more preferable for it to be 0%. It should be understood that since, at the present point in time, it has become possible to reduce the area porosity to 0.1%, accordingly it is desirable to reduce the area porosity down to 0.1% to 3% from the standpoint of being able to implement a good balance of excellent wear resistance, excellent thermal conductivity, productivity enhancement and so on. However, there is no limitation to any range of this type; it goes without saying that the area porosity may be outside this range, provided that it is still possible for the beneficial effects of the present invention to be manifested. Moreover, the cross sectional porosity of the coating layer may, for example, be obtained by observation of a sectional image of the coating layer obtained with a scanning electron microscope (SEM) or the like, or may be calculated by image processing of a digitalized sectional image obtained with a scanning electron microscope (SEM) or the like.

Yet further, the thickness of the coating layer described above is not to be considered as being particularly limited. In other words, while the thickness of the coating layer may be adjusted as appropriate according to the temperature and the sliding environment of the location at which it is to be applied, for example, it is preferable for this thickness to be from 0.05 mm to 5.0 mm, and more preferably for it to be from 0.1 mm to 2.0 mm. If this thickness is less than 0.05 mm, then the rigidity of the coating layer itself becomes insufficient, so that in some cases plastic deformation may take place, in particular if the strength of the base substrate is low. Moreover, if this thickness is greater than 10 mm, then there is a possibility that detachment of the coating layer may take place, due to the relationship between the residual stress and the interface adhesion strength that occurs during layer formation.

Even further, iron base alloy particles, cobalt base alloy particles, chromium base alloy particles, nickel base alloy particles, molybdenum base alloy particles, or ceramic particles may be cited as the inorganic particles described above. Furthermore, ceramic particles that are per se known in the prior art for application to a sliding member may be employed. A single type of such inorganic particles may be applied, or two or more types thereof may be applied in combination. A sliding member to which such particles are applied has excellent wear resistance and excellent thermal conductivity.

Still further, a hard iron base alloy such as Fe-28Cr-16Ni-4.5Mo-1.5Si-1.75C or the like may be cited as a specific example of the iron base alloy described above.

Moreover, for example, a hard cobalt base alloy such as TRIBALOY (registered trademark) T-400 or the like, or a hard cobalt base alloy such as Stellite (registered trademark) 6 or the like may be cited as a specific example of the cobalt base alloy described above. Additionally, a hard nickel base alloy such as TRIBALOY (registered trademark) T-700 or Ni700 (registered trademark) (Ni-32Mo-16Cr-3.1Si) or the like may be cited as a specific example of the nickel base alloy described above. Due to this, it is possible to implement even more excellent wear resistance and thermal conductivity.

It is desirable for the Vickers hardness of the inorganic portion to be 500 HV or greater and to be 1500 HV or less, although this should not be considered as being particularly limitative. Due to this, it is possible to implement even more excellent wear resistance and thermal conductivity.

Moreover, it is desirable for the Vickers hardness of the metal portion to be less than 500 HV, although this should not be considered as being particularly limitative. And it should be understood that it is desirable for the lower limit of the Vickers hardness of the metal portion derived from the iron base alloy particles other than listed in the above group to be 150 HV or greater, and more desirable for it to be 200 HV or greater, and even more desirable for it to be 300 HV or greater, although this should not be considered as being particularly limitative. Furthermore, it is desirable for the lower limit of the Vickers hardness of the metal portion derived from the copper particles or the copper base alloy particles to be 80 HV or greater, although this should not be considered as being particularly limitative. Due to this, it is possible to implement yet more excellent wear resistance and thermal conductivity.

And a stainless steel having an austenite phase, in other words an austenitic stainless steel, may be cited as an appropriate example of the other iron base alloy described above. For example, it is preferable to apply SUS316L or SUS304L or the like as specified by Japanese Industrial Standards as such an austenitic stainless steel. Due to this, it is possible to implement more excellent wear resistance and thermal conductivity.

Furthermore, for example, pure copper, or an alloy containing 50 mass percent of copper or more, or a precipitation hardening type copper alloy or the like such as Corson alloy may be cited as the copper or copper alloy described above. More specifically, pure copper or cupronickel, or a precipitation hardening type copper alloy or the like, may be cited as an appropriate example. Due to this, it is possible to implement more excellent wear resistance and thermal conductivity.

Here, the hardnesses of various portions (such as, for example, the inorganic portion or the metal portion or the like) or particles (such as, for example, the inorganic particles or the metal particles or the like) may, for example, be expressed in terms of their Vickers hardness as measured and calculated in conformity with the Vickers hardness test (JIS Z2244) stipulated by Japanese Industrial Standards. Moreover, as this Vickers hardness, for example for the coating layer, an average value may be applied that is calculated by obtaining measurements, for the inorganic portion or the metal portion, at around three to thirty locations and at least at three to five locations, and for the inorganic particles or the metal particles, upon around three to thirty units thereof and at least upon three to five units thereof. Additionally, when measuring and calculating the Vickers hardness for various portions or the like, according to requirements, observation of scanning electron microscope (SEM) images and/or of transmission electron microscope (TEM) images of the coating layer or the like, or energy dispersive X-ray (EDX) analysis or the like, may be combined.

It should be understood that, in a case of forming a coating layer upon a base substrate by substantially a similar method to that of Examples described hereinafter, the Vickers hardness of Fe-28Cr-16Ni-4.5Mo-1.5Si-1.75C is around 624 HV, the Vickers hardness of TRIBALOY (registered trademark) T-400 is around 792 HV, the Vickers hardness of Stellite (registered trademark) 6 is around 676 HV, the Vickers hardness of TRIBALOY (registered trademark) T-700 is around 779 HV, and the Vickers hardness of NI700 (registered trademark) is around 779 HV to 836 HV.

It is desirable for the Young's modulus of the inorganic portion to be 100 GPa or greater, and more desirable for it to be 150 GPa or greater, and even more desirable for it to be 200 GPa or greater, although this should not be considered as being particularly limitative. And it should also be understood that it is desirable for the upper limit of the Young's modulus of the inorganic portion to be 1000 GPa or less, and more desirable for it to be 500 GPa or less, and even more desirable for it to be 300 GPa or less, although this should not be considered as being particularly limitative. Due to this, it is possible to implement excellent wear resistance, thermal conductivity, and deformation resistance.

Here, the Young's modulus of the various portions (for example, the inorganic portions, the metal portions, and so on) and of the particles (for example, the inorganic particles, the metal particles, and so on) were measured by fixing the test specimen upon a stage of a micro indenter (a Nano Indenter XP made by MTS Systems Co. Ltd.) and employing an indenter (Berkovich) shaped as a triangular pyramid, and by obtaining data by repeatedly performing continuous stiffness measurement five times (according to a technique patented by MTS Systems). The data obtained as described above can be measured by analysis under the analysis condition that the Young's modulus is calculated with a numerical value at a contact depth of around 800 nm.

Furthermore, although this is not to be considered as being particularly limitative, at least one of the diffusion layer and the intermetallic compound layer may be either a diffusion layer or an intermetallic compound layer, or may include both a diffusion layer and an intermetallic compound layer. A diffusion layer having a graduated compositional structure may be cited as a preferred example of the diffusion layer. However, the diffusion layer is not to be considered as being limited to having such a graduated compositional structure. Moreover, although this is not to be considered as being particularly limitative, as a preferred example of a structure that includes an intermetallic compound layer, a structure may be cited in which an intermetallic compound layer is sandwiched by diffusion layers having a graduated compositional structure. A layer such as a diffusion layer or an intermetallic compound layer or the like is structured from component elements included in, for example, the base substrate, the predetermined inorganic portion, the predetermined metal portion, and so on. Specifically, if an aluminum alloy is employed as the base substrate and an austenitic stainless steel is employed as the metal portion, in some cases a layer is formed that is made from an alloy having aluminum and austenitic stainless steel as component elements. Moreover, if an aluminum alloy is employed as the base substrate and a cobalt base alloy is employed as the inorganic portion, in some cases a layer is formed that is made from an alloy having aluminum and cobalt as component elements. However the present invention is not to be considered as being limited to these cases; for example, if the present invention is applied to an aluminum alloy that is employed as the base substrate and to a nickel base alloy that is employed as the inorganic portion, then in some cases a layer is formed that is made from an alloy having aluminum and nickel.

Although this is not intended to be particularly limitative, from the standpoint of assuring more excellent wear resistance and thermal conductivity, it is desirable for the proportion of the predetermined inorganic portion in the cross section of the coating layer to be from 1 to 50 area percent, and more desirable for it to be from 10 to 50 area percent, and even more desirable for it to be from 10 to 40 area percent; and in particular it is desirable for this proportion to be from 10 to 20 mass percent. However, the proportion is not to be considered as being limited to any of these ranges; it goes without saying that, provided that it is possible to manifest the beneficial effects of this invention, it would also be acceptable for the proportion to be outside these ranges. Moreover, it should be understood that, in the cross section of the coating layer, the ratio of the inorganic portion may be calculated by, for example, observing a scanning electronic microscope (SEM) image of a cross section of the coating layer or the like, and by performing image processing of the digitalized cross sectional scanning electronic microscope (SEM) image or the like. Moreover, it goes without saying that area percent calculated by observation of a cross section can be regarded as volume percent, and volume percent can be converted to weight percent using the density of the respective particles.

It should be understood that, as described above, from the standpoint of assuring more excellent wear resistance and thermal conductivity, it is desirable for the proportion of the inorganic portion in the cross section of the coating layer to be from 1 to 50 area percent, but on the other hand, if high thermal conductivity is not necessarily required, then, if excellent wear resistance is required, there will be no problem if the proportion of the inorganic portion in the cross section of the coating layer is from 50 to 99 area percent.

2nd Embodiment

Next, a sliding member according to a second embodiment of the present invention will be explained in detail with reference to the drawings. It should be understood that the same reference symbols will be appended to elements that are equivalent to those explained in connection with the embodiment described above, and explanation thereof will be curtailed.

Figure 7:
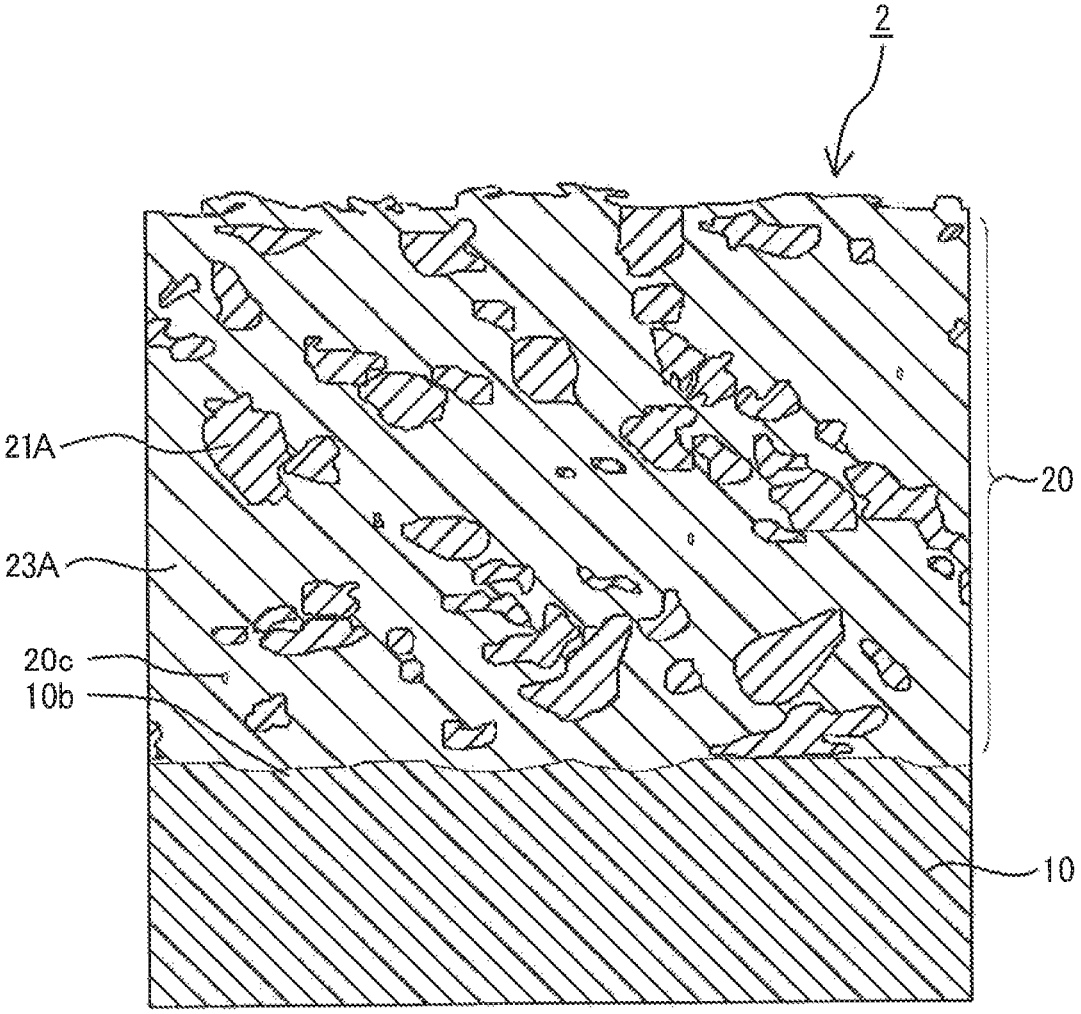
FIG. 7 is a schematic view showing a section of a sliding member according to a second embodiment of the present invention.

FIG. 7 is a schematic view showing a section of a sliding member according to a second embodiment of the present invention. As shown in FIG. 7, the sliding member 2 of this embodiment comprises a base substrate 10 and a coating layer 20 formed upon the base substrate 10. And the coating layer 20 comprises a predetermined hard material portion 21A and a predetermined soft material portion 23A. Moreover, in the coating layer 20, these portions are bonded together via the interface. It should be understood that the coating layer may also include pores 20*c*, although this is not to be considered as being particularly limitative. Moreover, the base substrate 10 may also include a plastically deformed portion 10*b* consisting of a flattened concave portion over its entire interface with the coating layer 20, although this is not to be considered as being particularly limitative.

And, at least at a portion of at least one of the interface between the base substrate 10 and the coating layer 20, and the interfaces between the various portions (for example, between two of the hard material portions 21A, 21A, or between an inorganic portion 21A and a metal portion 23A, or between two of the metal portions 23A, 23A), this sliding member 2 comprises an interface layer that includes at least one of a diffusion layer and an intermetallic compound layer. In other words, it would be possible for such an interface layer to be formed as the interface between a hard material portion or a soft material portion and the base substrate, or the interface between two hard material portions, or the interface between a hard material portion and a soft material portion, or the interface between two soft material portions, or the like. The thickness of this interface layer is 2 μm or less. It should be understood that FIG. 2 to FIG. 6 may be referred to in relation to the sliding member 2 of this embodiment as well. In this case, the inorganic portions 21 of FIG. 2 to FIG. 6 should be interpreted as being the hard material portions 21A, and the metal portions 23 should be interpreted as being the soft material portions 23A.

Here, the predetermined hard material portion is a material whose Vickers hardness is 500 HV or greater and 1500 HV or less; provided that it is derived from hard material particles, its components should not be considered as being particularly limited. Moreover, the predetermined soft material portion is a material whose Vickers hardness is less than 500 HV; provided that it is derived from soft material particles, its components should not be considered as being particularly limited.

Since, as described above, the sliding member of this embodiment is a sliding member comprising a base substrate and a coating layer formed upon that base substrate, with the coating layer comprising the predetermined hard material portion and the predetermined soft material portion and with these two portions being bonded together by the interface, and having an interface layer that includes at least one of a diffusion layer and an intermetallic compound layer on at least one portion of one of the interface between the base substrate and the coating layer, and the interfaces between the above described portions, and in which the thickness of the interface layer is 2 μm or less, accordingly it has excellent wear resistance and excellent thermal conductivity.

In other words, as compared with a sliding member having a coating layer obtained by performing sintering processing, the sliding member of this embodiment has excellent wear resistance and excellent thermal conductivity. And, as compared with a sliding member having a coating layer obtained by performing sintering processing, the sliding member of this embodiment has excellent wear resistance and excellent thermal conductivity even if the proportional content of the hard material portion is relatively low. Moreover, even with a coating layer having a hard material portion and/or a soft material portion whose thermal conductivity is not high, since the thickness of the interface layer is 2 μm or less, accordingly it becomes possible to suppress or to prevent deterioration of the thermal conductivity, so that this sliding member has excellent wear resistance and excellent thermal conductivity.

On the other hand, the desired beneficial effect cannot be achieved when the thickness of the interface layer is greater than 2 μm, since a component included in the hard material portion diffuses into, for example, the base substrate or into the soft material portion that preferably consists of a base material. It should be understood that, in consideration of the limitation at the present point in time for detection of the interface layer by transmission electronic microscopy (TEM) sectional imaging or by energy dispersive X-ray (EDX) analysis, the lower limit for the thickness of the interface layer is around 30 nm. Moreover, although this is not to be considered as being particularly limitative, the thickness of the interface layer is desirably 1 μm or less, and more desirably is 0.5 μm or less. And furthermore, although this is not to be considered as being particularly limitative, the thickness of the interface layer is desirably 0.03 μm or greater, and more desirably is 0.05 μm or greater, and even more desirably is 0.1 μm or greater.

Moreover, in this sliding member, it is desirable for at least one of the base substrate and the coating layer to include a plastically deformed portion. Due to this, it is possible to implement wear resistance and thermal conductivity that are yet more excellent.

At the present point in time, it is considered that the beneficial effects described above are obtained due to at least one of the following reasons.

For example, when spraying onto the base substrate the hard material particles or the soft material particles described above, which are some of the raw materials used in the method for manufacturing this sliding member, a part of their kinetic energy is converted into thermal energy, and deposition or atomic diffusion between the hard material particles or the soft material particles and the base substrate takes place in an extremely short time period as compared to the case during sintering processing. Furthermore, in some cases, deposition or atomic diffusion also takes place between the hard material particles or the soft material ides and the hard material portion or the soft material portion that is adhered to the base substrate in an extremely short time period as compared to the case during sintering processing. Yet further, heat is generated when the hard material particles or the soft material particles collide with the base substrate or with the hard material portion or the soft material portion that is adhered to the base substrate and plastic deformation takes place, so that sometimes deposition or atomic diffusion occurs. It is considered that the above described beneficial effects can be ascribed to the fact that, due to the above described phenomena, the adhesion between the hard material portion and/or the soft material portion and the base substrate, and/or the adhesion between the portions such as the hard material portion and the soft material portion and so on, is improved. To put it in another manner, it is considered that this is also because the adhesion between the hard material portion or the soft material portion and the base substrate, and/or the adhesion between the hard material portion and the soft material portion and so on, is enhanced by the formation of an interface layer whose thickness is 2 μm or less and that has at least one of a diffusion layer and an intermetallic compound layer at least in a portion of at least one of the interface between the base substrate and the coating layer and the interfaces between the various portions.

Furthermore it is considered that the above described beneficial effects can also be ascribed to the fact that, when for example hard material particles or soft material particles as described above are sprayed upon the base substrate, as a result of an anchoring effect due to the hard material particles or soft material particles sinking into the base substrate or into a hard material portion or a soft material portion that is adhered to the base substrate, the adhesion between the hard material portion or soft material portion and the base substrate and/or the adhesion between the various portions such as the hard material portion or the soft material portion or the like is enhanced. To put it in another manner, it is considered that the above described beneficial effects may be due to the fact that the adhesion between the hard material portion or the soft material portion and the base substrate, or the adhesion between the various portions such as the hard material portion or the soft material portion and so on, is enhanced due to the formation of the plastically deformed portion.

Moreover it is also considered that the above described beneficial effects can be ascribed to the fact that, when for example the hard material particles or the soft material particles as described above are sprayed upon the base substrate, if, for example the base substrate had an oxidized layer on its surface that would have impeded the adhesion between the base substrate and the coating layer, then this oxidized layer is removed by the hard material particles or the soft material particles, so that a newly generated interface whose adhesion to the coating layer is excellent is formed upon the base substrate and is exposed.

However, it goes without saying that, even if beneficial effects such as described above are obtained due to reasons other than those described above, this still comes within the scope of the present invention.

Now, the various components will be further explained in more detail.

It is desirable for the Vickers hardness of the hard material particles described above to be 500 HV or greater and 1500 HV or less. Iron base alloy particles, cobalt base alloy particles, chromium base alloy particles, nickel base alloy particles, molybdenum base alloy particles, ceramic particles or the like may be cited as preferred examples of the hard material particles described above. Moreover, ceramic particles that are per se known in the prior art for application to a sliding member may be employed. A single type of such hard particles may be applied, or two or more types thereof may be applied in combination. Due to this, it is possible to implement more excellent wear resistance and thermal conductivity.

Furthermore, a hard iron base alloy such as Fe-28Cr-16Ni-4.5Mo-1.5Si-1.75C (Vickers hardness around 624 HV) or the like may be cited as a specific example of the iron base alloy described above. Moreover, for example, a hard cobalt base alloy such as TRIBALOY (registered trademark) T-400 (Vickers hardness around 792 HV) or the like, or a hard cobalt base alloy such as Stellite (registered trademark) 6 (Vickers hardness around 676 HV) or the like may be cited as a specific example of the cobalt base alloy described above. Additionally, a hard nickel base alloy such as TRIBALOY (registered trademark) T-700 (Vickers hardness around 779 HV) or Ni700 (registered trademark) (Ni-32Mo-16Cr-3.1Si) (Vickers hardness around 779 HV to 836 HV) or the like may be cited as a specific example of the nickel base alloy described above. Due to this, it is possible to implement more excellent wear resistance and thermal conductivity.

Even further, it is desirable for the Young's modulus of the hard material portion to be 100 GPa or greater, and more desirable for it to be 150 GPa or greater, and even more desirable for it to be 200 GPa or greater, although this should not be considered as being particularly limitative. And it should also be understood that it is desirable for the upper limit of the Young's modulus of the hard material portion to be 1000 GPa or less, and more desirable for it to be 500 GPa or less, and even more desirable for it to be 300 GPa or less, although this should not be considered as being particularly limitative. Due to this, it is possible to implement more excellent wear resistance and thermal conductivity.

Moreover, it is desirable for the Vickers hardness of the soft material particles described above to be less than 500 HV. Iron base alloy particles other than listed in the above group, copper particles, copper alloy particles or the like may be cited as preferred examples of the soft material particles described above. It will be acceptable for a single type of these to be applied singly, or for two or more types thereof to be applied in combination. Due to this, it is possible to implement more excellent wear resistance and thermal conductivity.

And a stainless steel having an austenite phase, in other words an austenitic stainless steel, may be cited as an appropriate example of the other iron base alloy described above. For example, it is preferable to apply SUS316L or SUS304L or the like as specified by Japanese Industrial Standards as such an austenitic stainless steel. Due to this, it is possible to implement more excellent wear resistance and thermal conductivity.

Furthermore, for example, pure copper, or an alloy containing 50 mass percent of copper or more, or a precipitation hardening type copper alloy or the like such as Corson alloy may be cited as the copper or copper alloy described above. For example, pure copper or cupronickel, or a precipitation hardening type copper alloy or the like, may be cited as an appropriate example. Due to this, it is possible to implement more excellent wear resistance and thermal conductivity.

Furthermore, if the soft material particles are made from some other iron base alloy, then it is desirable for the lower limit of the Vickers hardness of the soft material portion to be 150 HV or greater, and more desirable for it to be 200 HV or greater, and even more desirable for it to be 300 HV or greater, although this is not to be considered as being particularly limitative. Due to this, it is possible to implement more excellent wear resistance and thermal conductivity.

Moreover, if the soft material particles are made from copper or a copper alloy, then it is desirable for the lower limit of the Vickers hardness of the soft material portion to be 80 HV or greater, although this is not to be considered as being particularly limitative. Due to this, it is possible to implement more excellent wear resistance and thermal conductivity.

3rd Embodiment

Next, a sliding member according to a third embodiment of the present invention, in other words a sliding member having the sliding member as described above on a sliding region, will be explained in detail with reference to the drawings. It should be understood that, while a sliding member of an internal combustion engine is here cited and described in detail as an example of a sliding member, this should not be considered as being particularly limitative. Moreover, it goes without saying that the surface of the coating layer is employed as the sliding surface. It should be understood that the same reference symbols will be appended to elements that are equivalent to those explained in connection with the embodiments described above, and explanation thereof will be curtailed.

Figure 8:
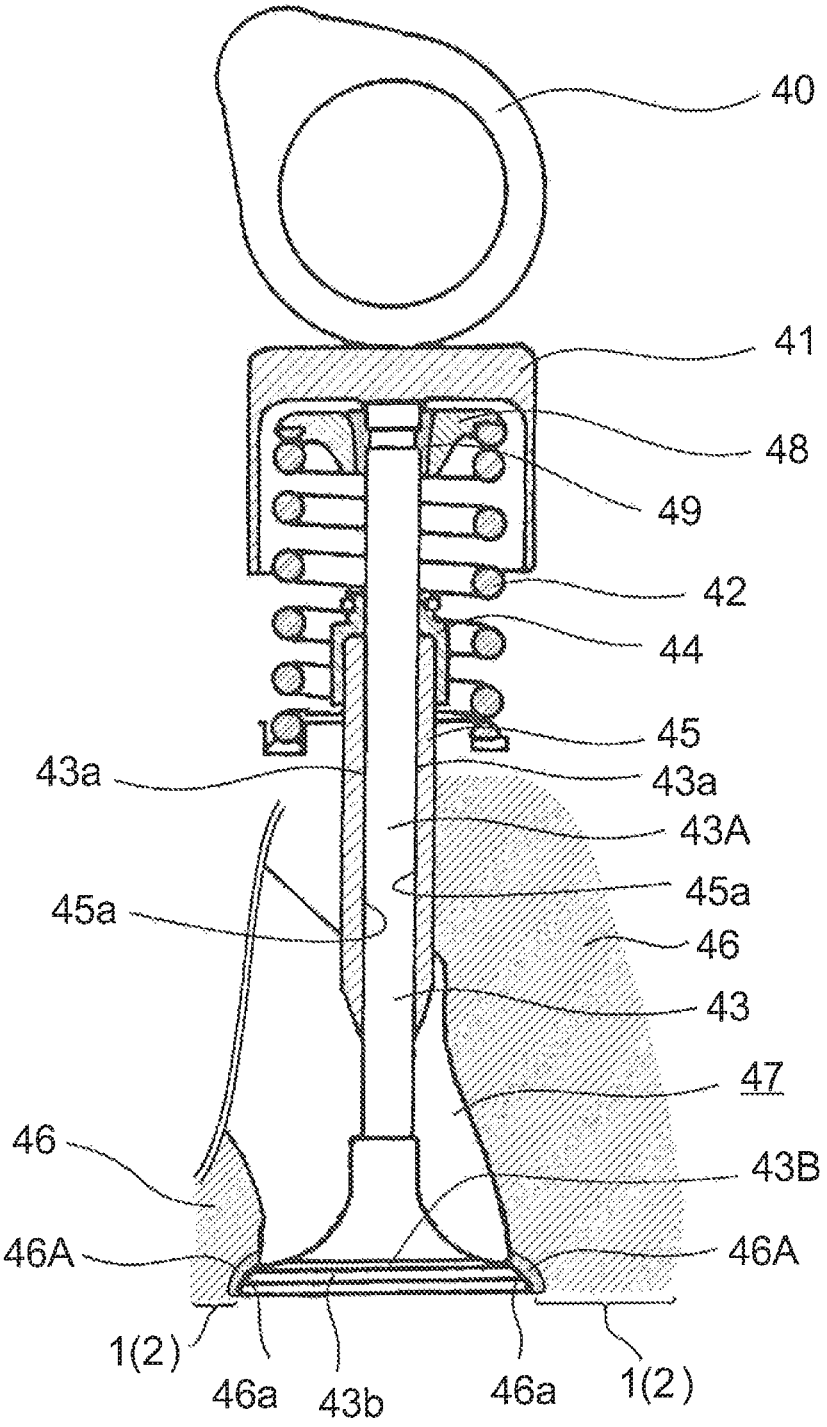
FIG. 8 is a schematic view showing a section of a sliding member of an internal combustion engine that incorporates a sliding member upon a sliding region of the internal combustion engine.

FIG. 8 is a schematic view showing a section of this sliding member of an internal combustion engine that incorporates a sliding member upon a sliding region of the internal combustion engine. More specifically, this figure is a schematic view showing a section of a valve drive mechanism that includes an engine valve. As shown in FIG. 8, when a cam lobe 40 rotates, a valve lifter 41 is pushed downward and compresses a valve spring 42, and simultaneously an engine valve 43 is pushed downward while being guided by a valve guide 45 that has a stem seal 44, and thereby the engine valve 43 is removed from a seat portion 46A for the engine valve 43 of a cylinder head 46, so that an exhaust port 47 and a combustion chamber not shown in the figures are communicated together (i.e. the engine valve is put into the opened state). Thereafter, when the cam lobe 40 rotates further, due to the resilient force of the valve spring 42, the engine valve 43 is pressed upward along with the valve lifter 41, a retainer 48, and a cotter 49, so that the engine valve 43 is brought into contact with the seat portion 46A and the exhaust port 47 and the combustion chamber not shown in the figures are cut off from one another (i.e. the engine valve is put into the closed state). In this manner, the opening and closing of the engine valve 43 are performed in synchronization with the rotation of the cam lobe 40. And, with this construction, the valve stem 43A of the engine valve 43 passes through the interior of the valve guide 45 which is pressed into the cylinder head 46, while being lubricated with oil. Moreover, during this operation, a valve face 43B of the engine valve 43, which touches against an opening/closing valve portion of the combustion chamber not shown in the figures, is brought into a contacting state or a non-contacting state with a seat portion 46A for the engine valve 43 of the cylinder head 46. It should be understood that, while an exhaust port 47 side is shown in FIG. 8, the sliding member of the present invention could also be applied to an intake port side not shown in the figures.

And a sliding member upon which a coating layer such as described above is formed, for example such as the sliding member 1 or 2 of the first embodiment or the second embodiment described above, is applied to a sliding surface 46*a* of the seat portion 46A for the engine valve of the cylinder head, which is a sliding region between the cylinder head and the engine valve. Due to this, the region is endowed with excellent wear resistance and excellent thermal conductivity, as compared to a sliding member having a coating layer obtained by performing sintering processing. Moreover, as compared to a sliding member having a coating layer obtained by performing sintering processing, this region has excellent wear resistance and excellent thermal conductivity, even if the proportional content of the inorganic portion is small. Furthermore, even with a coating layer that has an inorganic portion or a metal portion whose thermal conductivity is not high, since the thickness of the interface layer is 2 μm or less, accordingly it becomes possible to suppress and prevent decrease of the thermal conductivity, so that excellent wear resistance and excellent thermal conductivity are obtained. Yet further, by applying the sliding member of the present invention to a cylinder head, it becomes possible to avoid the provision of a pressed-in valve seat. As a result, it becomes possible to anticipate more freedom in the design of the exhaust port and of the intake port and increase of the diameters of the engine valves, so that it becomes possible to improve the fuel consumption of the engine and its power output and torque and so on.

Moreover, for example, although this concept is not shown in the figures, it would also be possible to apply a sliding member upon which a coating layer such as described above has been formed, for example the sliding member of the first embodiment or the second embodiment described above, to at least one location selected from the group consisting of one or both of the sliding surface of the valve stem and the sliding surface of the valve guide which is the mating member therewith, and/or the sliding surface of the end of the valve stem shaft, the sliding surface of the valve face, and the sliding surface of the pressed-in valve seat. Due to this, it is possible to obtain excellent wear resistance and excellent thermal conductivity, as compared to the case of a sliding member having a coating layer that is obtained by performing sintering processing. Moreover, as compared to the case of a sliding member having a coating layer that is obtained by performing sintering processing, even if the proportional content of the inorganic portion is small, it is still possible to obtain excellent wear resistance and excellent thermal conductivity. Furthermore, even in the case of a coating layer having an inorganic portion or a metal portion whose thermal conductivity is not high, since the thickness of the interface layer is 2 μm or less, accordingly it becomes possible to suppress and prevent decrease of the thermal conductivity, so that excellent wear resistance and excellent thermal conductivity are obtained.

In other words, the cylinder head of this embodiment preferably has a sliding member of one of the embodiments described above in the seat portion for the engine valve. Moreover, another cylinder head of this embodiment is a cylinder head comprising a valve seat having a sliding member of the embodiment described above, and preferably has the sliding member in an engine valve seat portion of the valve seat. Furthermore, the valve seat of this embodiment preferably has a sliding member of the embodiment described above in an engine valve seat part. Even further, the engine valve of this embodiment preferably has a sliding member of the embodiment described above in a valve face. Still further, another engine valve of this embodiment preferably has a sliding member of the embodiment described above in a sliding region with a valve guide.

4th Embodiment

Next, a sliding member according to a fourth embodiment of the present invention will be explained in detail with reference to the drawings. It goes without saying that the surface side of the coating layer constitutes the sliding surface. Moreover, it should be understood that the same reference symbols will be appended to elements that are equivalent to those explained in connection with the embodiments described above, and explanation thereof will be curtailed.

Figure 9:
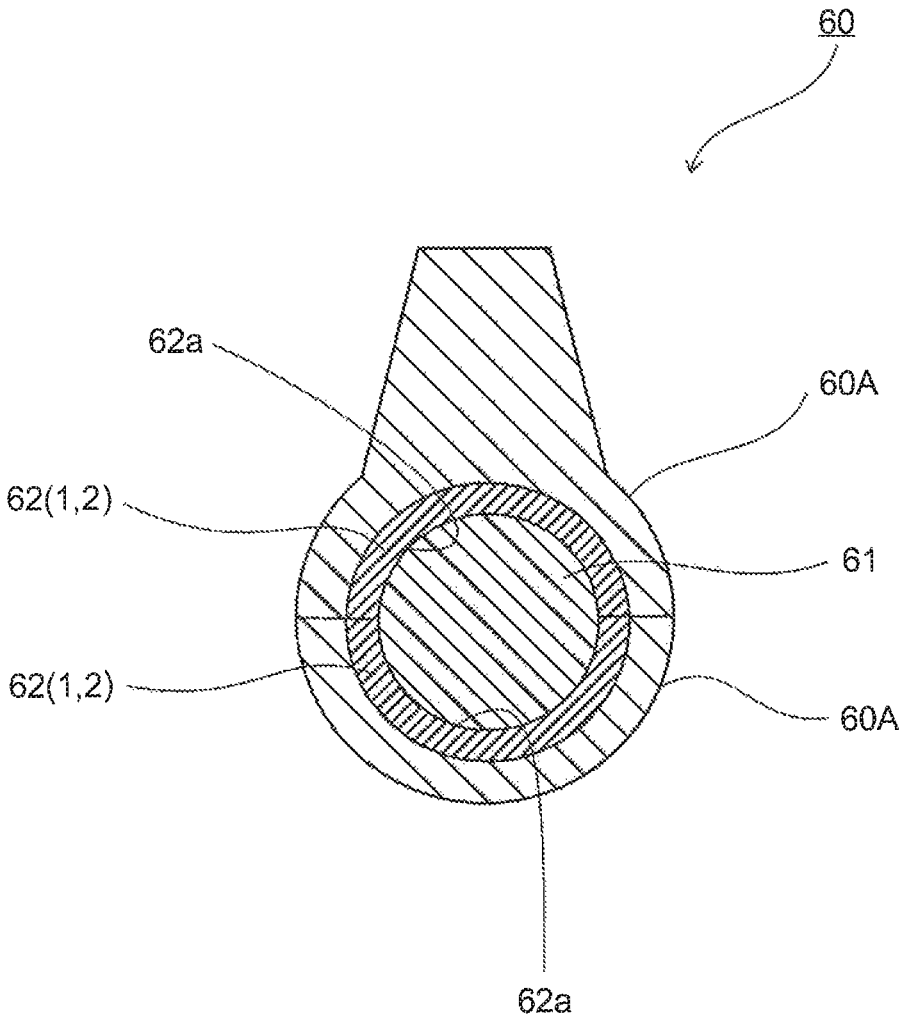
FIG. 9 is a schematic view showing a section of a bearing mechanism of an internal combustion engine that incorporates a sliding member upon bearing metal of a bearing mechanism thereof.

FIG. 9 is a schematic view showing a section of a bearing mechanism of an internal combustion engine that incorporates a sliding member upon bearing metal of a bearing mechanism of the internal combustion engine. More specifically, this figure is a sectional view schematically showing a bearing metal that is a sliding member of a connection rod. As shown in FIG. 9, a big end portion 60A at the crank end of a connection rod 60 not shown in the figures is divided vertically into an upper section and a lower section. And a bearing metal 62 that is divided into two sections for receiving a crank pin 61 is disposed in the big end portion 60A.

And, as this bearing metal 62, a sliding member upon which a coating layer as described above is formed, i.e. for example a sliding member (1, 2) of the first embodiment or the second embodiment described above, is applied upon this sliding surface 62*a*. Due to this, excellent wear resistance and excellent thermal conductivity are obtained, as compared with the case of a sliding member having a coating layer obtained by sintering processing. Moreover it is possible to obtain excellent wear resistance and excellent thermal conductivity, as compared with the case of a sliding member having a coating layer obtained by sintering processing, even if the proportional content of the inorganic portion is small. Furthermore, even in the case of a coating layer having an inorganic portion or a metal portion whose thermal conductivity is not high, since the thickness of the interface layer is 2 μm or less, accordingly it becomes possible to suppress and prevent decrease of the thermal conductivity, so that excellent wear resistance and excellent thermal conductivity are obtained.

Furthermore, for example, although this feature is not shown in the figures, it would also be possible to apply a sliding member upon which a coating layer as described above is formed, for example a sliding member according to the first embodiment or the second embodiment of the present invention as described above, for the sliding surface of a bearing metal that is divided into two parts for receiving a piston pin at a small end portion of the connection rod on the piston side, not shown in the figures. Due to this, it is possible to obtain excellent wear resistance and excellent thermal conductivity, as compared with the case of a sliding member having a coating layer obtained by sintering processing. Moreover, as compared with the case of a sliding member having a coating layer obtained by sintering processing, it is possible to obtain excellent wear resistance and excellent thermal conductivity, even if the proportional content of the inorganic portion is small. Furthermore, even in the case of a coating layer having an inorganic portion or a metal portion whose thermal conductivity is not high, since the thickness of the interface layer is 2 μm or less, accordingly it becomes possible to suppress and prevent decrease of the thermal conductivity, so that excellent wear resistance and excellent thermal conductivity are obtained.

In other words, the bearing mechanism of an internal combustion engine of this embodiment desirably includes a sliding member of the embodiment described above in the bearing metal of the bearing mechanism of the internal combustion engine. It would also be possible to form a layer directly upon the sliding surface on the big end side of the connection rod (i.e. by direct formation without employing any metal). Moreover, it would also be possible to form a layer directly upon the sliding surface on the small end side of the connection rod (i.e. by direct formation without employing any metal).

It should be understood that it would also be possible to apply the sliding member of an internal combustion engine according to the present embodiment to a piston ring and/or a piston. In other words, it would be desirable to apply a coating layer to the surface of a piston ring. Moreover, it would be desirable to apply a coating layer to the inner surface of a ring groove of a piston. Furthermore, regarding a sliding member of an internal combustion engine according to the present embodiment, it would be desirable to apply a coating layer upon the inner surface of a cylinder bore (this may be an alternative to a cylinder liner, or may be substituted for bore thermal spraying). Moreover, regarding a sliding member of an internal combustion engine of this embodiment, it would be desirable to apply a coating layer to a metal of a journal of a crank shaft. Yet further, regarding a sliding member of an internal combustion engine according to the present embodiment, it would be desirable to apply a coating layer at a site upon a metal of a journal of a crank shaft by directly forming the coating layer (i.e. by directly forming the coating layer without using any metal). Even further, regarding a sliding member of an internal combustion engine according to the present embodiment, it would be desirable to apply a coating layer upon the surface of the metal of the journal of a cam shaft. Moreover, regarding a sliding member of an internal combustion engine according to the present embodiment, it would be desirable to apply a coating layer at a site upon a metal of a journal of a cam shaft by directly forming the coating layer (i.e. by directly forming the coating layer without employing any metal). Still further, regarding a sliding member of an internal combustion engine according to the present embodiment, it would be desirable to apply a coating layer upon a cam lobe surface of a cam shaft. Furthermore, regarding sliding members of an internal combustion engine according to the present embodiment, it would be desirable to apply coating layers at sites of metal of a piston and a piston pin. Moreover, regarding sliding members of an internal combustion engine according to the present embodiment, it would be desirable to apply coating layers at sites of metal of a piston and a piston pin by direct layer formation. Even further, regarding a sliding member of an internal combustion engine according to the present embodiment, it would be desirable to apply a coating layer upon the surface of a piston skirt. Furthermore, regarding a sliding member of an internal combustion engine according to the present embodiment, it would be desirable to apply a coating layer upon the crown surface of a valve lifter. Still further, regarding a sliding member of an internal combustion engine according to the present embodiment, it would be desirable to apply a coating layer upon the side surface of a valve lifter. Yet further, regarding a sliding member of an internal combustion engine according to the present embodiment, it would be desirable to apply a coating layer upon the sliding surface of a valve lifter of a lifter bore in a cylinder head. Yet further, regarding a sliding member of an internal combustion engine according to the present embodiment, it would be desirable to apply a coating layer to the surface of the teeth of a sprocket (in this case, for example, instead of being formed upon a sintered iron alloy sprocket, the coating layer may be formed upon a sintered aluminum alloy sprocket). Furthermore, regarding a sliding member of an internal combustion engine according to the present embodiment, it would be desirable to apply a coating layer to a chain pin. Moreover, regarding a sliding member of an internal combustion engine according to the present embodiment, it would be desirable to apply a coating layer to a chain plate.

Furthermore, it is desirable to apply a sliding member according to the first embodiment or the second embodiment described above to surfaces of the teeth of other gear wheels than that of the internal combustion engine (in this case, for example, a steel gear wheel may be substituted with one that is made from aluminum alloy, and a coating layer may be formed upon the aluminum alloy). Here, as the other gear wheels than that of the internal combustion engine, for example, a differential gear of an automobile, or a gear wheel of a generator of an automobile, or a gear wheel of other generators than that of an automobile may be cited. Moreover, it is desirable to apply a sliding member according to the first embodiment or the second embodiment described above to a general slippage bearing (meaning a slippage bearing in a broad sense that is not a rolling bearing).

Next, a method of manufacturing the sliding member will be explained in detail. This method for manufacturing a sliding member is, for example, a method of manufacturing a sliding member according to the embodiment described above that is provided with a base substrate and a coating layer formed upon the base substrate, in which the coating layer includes a predetermined inorganic portion or hard material portion and a predetermined metal portion or soft material portion, in which the portions are bonded together via the interface, and that including at least one of a diffusion layer and an intermetallic compound layer at least in a portion of at least one of the interface between the base substrate and the coating layer and the interface between the portions, and having an interface layer whose thickness is 2 μm or less. This method for manufacturing a sliding member includes a process of forming a predetermined coating layer upon the base substrate by spraying a mixture having the inorganic particles or hard material particles described above and the metal particles or soft material particles described above upon the base substrate in a non-melted state.

As described above, by spraying the mixture upon the base substrate in the non-melted state and thus forming the predetermined coating layer upon the base substrate, it is possible to form a coating layer whose wear resistance and thermal conductivity are excellent with good efficiency. To put it in another manner, it is possible to form a coating layer whose wear resistance and thermal conductivity are excellent with good efficiency by a method such as so-called kinetic spraying, cold spraying, warm spraying, or the like. However, the sliding member of the present invention is not limited to that produced by this type of a production method.

Now, a more concrete method of manufacture will be explained in further detail.

As described above, when spraying the mixture upon the base substrate, it is desirable to spray the mixture upon the base substrate at such a speed that a plastically deformed portion is formed upon at least one of the base substrate and the coating layer. By doing this, it is possible to form a coating layer that has better wear resistance and thermal conductivity with good efficiency.

However, the speed of spraying the mixture is not to be considered as being limited to one such as described above. For example, it is desirable to set the particle speed to 300 m/s to 1200 m/s, and more desirable to set that speed to 500 m/s to 1000 m/s, and still more desirable to set it to 600 m/s to 800 m/s. Moreover, it is desirable to set the pressure of the operation gas that is supplied for spraying the particles to 2 MPa to 5 MPa, and more desirable to set that pressure to 3.5 MPa to 5 MPa. If the pressure of the operation gas is less than 2 MPa, then sometimes sufficient particle speed cannot be obtained, and the porosity becomes great. However, these ranges for the operational parameters are not to be considered as being limitative; provided that it is possible to realize the beneficial effects of the present invention, it goes without saying that it would be acceptable for the parameters to be outside these ranges.

Furthermore, while the temperature of the operation gas is not to be considered as being particularly limited, for example, it is desirable for it to be set to from 400° C. to 800° C., and more desirable for it to be set to from 600° C. to 800° C. If the temperature of the operation gas is set to less than 400° C., then sometimes the porosity becomes great, so that the wear resistance and the thermal conductivity become low. Moreover, if the temperature of the operation gas is set to more than 800° C., then sometimes nozzle clogging takes place. However, this range for the operation gas temperature is not to be considered as being limitative; provided that it is possible to realize the beneficial effects of the present invention, it goes without saying that it would be acceptable for the operation gas temperature to be outside this range.

Moreover, the type of the operation gas is not to be considered as being particularly limited; for example, nitrogen, helium, or the like may be cited for use. A single type of gas may be employed by itself, or gases of a plurality of types may be employed in combination. It would also be acceptable to employ a mixture of fuel gas and nitrogen.

Yet further, while the inorganic particles or the hard material particles that are employed as the raw material described above are not to be considered as being particularly limited provided that they are capable of providing the inorganic portion or the hard material portion described above, it is desirable to employ a type of particles for which the ratio of the Young's modulus of the inorganic portion with respect to the Young's modules of the inorganic particles becomes 1.5 or greater. By doing this, it is possible to form a coating layer that is excellent in wear resistance and thermal conductivity and also has excellent resistance to deformation with good efficiency, and also it is possible to enhance the quality of layer formation.

Even further, the metal particles or the soft material particles that are employed as the raw material described above are not to be considered as being particularly limited, provided that they are capable of providing the metal portion or the soft material portion described above.

EXAMPLES

Examples of the present invention will now be explained in further detail; but the present invention is not to be considered as being limited to these Examples.

Examples 1 to 3

First, as raw material, the inorganic particles and the metal particles shown in Table 1 were prepared. TRIBALOY T-400 and TRIBALOY T-700 shown in Table 1 and Table 2 were manufactured by Kennametal Stellite Co. Ltd.

On the other hand, in a state in which processing of a seat portion for an engine valve of a cylinder head was completed, while assuming a target coating layer thickness of 0.2 mm, a pre-processed aluminum base substrate was prepared by performing pre-processing upon an aluminum base substrate (Japanese Industrial Standard H4040 A5056).

Next, the prepared aluminum base substrate was installed upon a rotating table, and, while rotating the rotating table, a prepared mixture of inorganic particles and metal particles was sprayed upon the prepared aluminum base substrate by employing a high pressure type cold spray device, a Kinetics 4000 made by CGT Co. Ltd. with nozzle 27TC, at gas temperature 750° C., at gas pressure 3.6 MPa, at main gas flow rate 73 $m^3$/h, at carrier gas flow rate 4.5 $m^3$/h, at particle supply amount 43 g/min, and thereby a coating layer of thickness 0.4 mm to 0.5 mm was formed upon the base substrate.

And then the workpiece was finished by machining to the shape of a seat portion for an engine valve of the actual cylinder head, whereby a sliding member of each of these Examples was obtained. The thickness of the coating layer was 0.2 mm (and the same hereinafter).

Comparative Example 1

First, as raw material, the inorganic particles and the metal particles and so on shown in Table 2 were prepared.

Next, 1 mass percent of zinc stearate was added to and mixed into a prepared mixture of these inorganic particles and metal particles and so on, and this material was compression formed at a compression forming pressure of 7 tons/$cm^2$. A predetermined amount of copper for infiltration was disposed at the upper portion of this molded body, and sintering was performed for 30 minutes at a temperature of 1120° C. in an ammonia decomposition gas atmosphere, whereby a sintered body was obtained. Infiltration was performed simultaneously with this sintering.

On the other hand, in a state in which processing of the seat portion for an engine valve of a cylinder head was completed, while assuming a target coating layer thickness of 0.2 mm, a pre-processed aluminum base substrate was prepared by performing pre-processing upon an aluminum base substrate (Japanese Industrial Standard H4040 A5056).

Moreover, the sintered body prepared as described above was arranged by being pressed into the base substrate.

And then the workpiece was finished by machining to the shape of a seat portion for an engine valve of the actual cylinder head, whereby the sliding member of this Comparative Example was obtained.

Comparative Example 2 to Comparative Example 4

First, as raw material, the inorganic particles and the metal particles and so on shown in Table 2 were prepared.

Next, 1 mass percent of zinc stearate was added and mixed into a prepared mixture of these inorganic particles and metal particles and so on, and this material was compression formed at a compression forming pressure of 7 tons/$cm^2$. Sintering was performed upon these molded bodies for 30 minutes at a temperature of 1120° C. in an ammonia decomposition gas atmosphere, whereby sintered bodies were obtained.

On the other hand, in a state in which processing of a seat portion for an engine valve of a cylinder head was completed, while assuming a target coating layer thickness of 0.2 mm, a pre-processed aluminum base substrate was prepared by performing pre-processing upon an aluminum base substrate (Japanese Industrial Standard H4040 A5056).

Moreover, the sintered body prepared as described above was arranged by being pressed into the base substrate.

And then, by machining, the workpiece was finished to the shape of a seat portion for an engine valve of the actual cylinder head, whereby the sliding member of each of these examples was obtained.

TABLE 1

| | | Example 1 | Example 2 | Example 3 |
|---|---|---|---|---|
| inorganic portion | Material type | Tribaloy Material corresponding to T-400 Cobalt base alloy | Tribaloy Material corresponding to T-700 Nickel base alloy | Tribaloy Material corresponding to T-400 Cobalt base alloy |
| | Proportion in coating layer (area percent) (excluding pores) | 10 | 10 | 15 |
| | Hardness | 11.5 GPa (Corresponding to 876Hv0.1) | 779HV0.025 | 904Hv0.025 |
| | Young's modulus | — | — | 204 GPa |
| Metal portion | Material type | SUS316L | SUS316L | Corson alloy (Precipitation hardening type copper alloy) |
| | Proportion in coating layer (area percent) (excluding pores) | 60 | 60 | 85 |
| | Hardness | 413Hv0.1 | 354HV0.1 | 213Hv0.1 |
| Other portion (Metal portion) | Material type | Pure copper | Pure copper | — |
| | Proportion in coating layer (area percent) (excluding pores) | 30 | 30 | — |
| | Hardness | 103HV0.01 | 94HV0.01 | — |
| Interface layer | Thickness (μm) | 0.2 μm | 0.2 μm | 0.5 μm |
| Inorganic particles | Material type | Tribaloy Material corresponding to T-400 Cobalt base alloy | Tribaloy Material corresponding to T-700 Nickel base alloy | Tribaloy Material corresponding to T-400 Cobalt base alloy |
| | Young's modulus | — | — | 58.9 GPa |
| Metal particles | Material type | SUS316L | SUS316L | Corson alloy (Precipitation hardening type copper alloy) |
| Other particles (Metal particles) | Material type | Pure copper | Pure copper | — |
| Wear resistance | Wear amount (μm) | 21.0 | 16.0 | 18.0 |
| Thermal conductivity | Thermal conductivity (W/m · K) | — | — | 61 |

TABLE 2

| | | Comparative Example 1 | Comparative Example 2 | Comparative Example 3 | Comparative Example 4 |
|---|---|---|---|---|---|
| inorganic portion | Material type | Tribaloy Material corresponding to T-400 Cobalt base alloy | Tribaloy Material corresponding to T-400 Cobalt base alloy | Tribaloy Material corresponding to T-400 Cobalt base alloy | Cobalt base alloy |
| | Proportion in coating layer (area percent) (excluding pores) | 30 | 30 to 40 | 20 to 30 | 35 |
| | Hardness | 10.6 GPa (Corresponding to 808HV0.1) | 750Hv0.1 | 776Hv0.1 | 705Hv0.1 |
| | Young's modulus | 265 GPa | — | — | — |

TABLE 2-continued

| | | Comparative Example 1 | Comparative Example 2 | Comparative Example 3 | Comparative Example 4 |
|---|---|---|---|---|---|
| Metal portion | Material type | High speed steel | Iron | Iron | Iron |
| | Proportion in coating layer (area percent) (excluding pores) | — | — | — | — |
| | Hardness | — | — | — | — |
| Other portion (Metal portion) | Material type | Cupper, other | Carbon powder, MnS, other | Carbon powder, solid lubricant, other | Carbon powder, solid lubricant, other |
| | Proportion in coating layer (area percent) (excluding pores) | — | — | — | — |
| | Hardness | — | — | — | — |
| Interface layer | Thickness (μm) | More than 5 μm | More than 5 μm | More than 5 μm | More than 5 μm |
| Inorganic particles | Material type | Tribaloy Material corresponding to T-400 Cobalt base alloy | Tribaloy Material corresponding to T-400 Cobalt base alloy | Tribaloy Material corresponding to T-400 Cobalt base alloy | Cobalt base alloy |
| | Young's modulus | — | — | — | — |
| Metal particles | Material type | High speed steel | Iron | Iron | Iron |
| Other particles (Metal particles) | Material type | Cupper, other | Carbon powder, MnS, other | Carbon powder, solid lubricant, other | Carbon powder, solid lubricant, other |
| Wear resistance | Wear amount (μm) | 36.4 | 20.3 | 39.0 | 21.0 |
| Thermal conductivity | Thermal conductivity (W/m · K) | 25 | 12 | 14 | 15 |

Here, in Table 1 and Table 2, the Vickers hardnesses of the inorganic portions, the metal portions, the inorganic particles, and the metal particles were measured and calculated according to the Vickers hardness test specified by Japanese Industrial Standard JIS Z2244. Ten measurements were taken at different locations, and their mean value was obtained. Furthermore, when determining the locations for measurement, a scanning electronic microscope (SEM) image or a transmission electronic microscope (TEM) image or the like of the coating layer was observed, and/or the results of energy dispersive X-ray (EDX) analysis or the like were employed.

Moreover, the Young's modulus of the inorganic portions, of the metal portions, of the inorganic particles, and of the metal particles of Table 1 and Table 2 were measured by fixing the test specimens upon a stage of a micro indenter (a Nano Indenter XP made by MTS Systems Co. Ltd.) and employing an indenter (Berkovich) shaped as a triangular pyramid, and by obtaining data by repeatedly performing stiffness measurement five times, and by analyzing the obtained data under analysis conditions in which the value of the Young's modulus was calculated at a contact depth of around 800 nm.

Furthermore, the thicknesses of the interface layer at the base substrate and the coating layer of the sliding members of Table 1 and Table 2 was specified by observation of cross-sectional transmission electron microscope (TEM) images or the like, and by energy dispersive X-ray (EDX) analysis. Moreover, the presence or absence of a plastically deformed portion in the cross sections of the sliding member was specified by observation of cross-sectional scanning electron microscope (SEM) images or the like, and by energy dispersive X-ray (EDX) analysis.

Example 1 to Example 3, only interface layers of 2 μm thickness or less were observed. On the other hand, in Comparative Example 1 to Comparative Example 4, it was observed that the thicknesses of at least one of the interface layers was greater than 2 μm, and more precisely were greater than 5 μm. Moreover, in Example 1 to Example 3, plastically deformed portions were observed in the base substrate and the coating layer.

Figure 10:
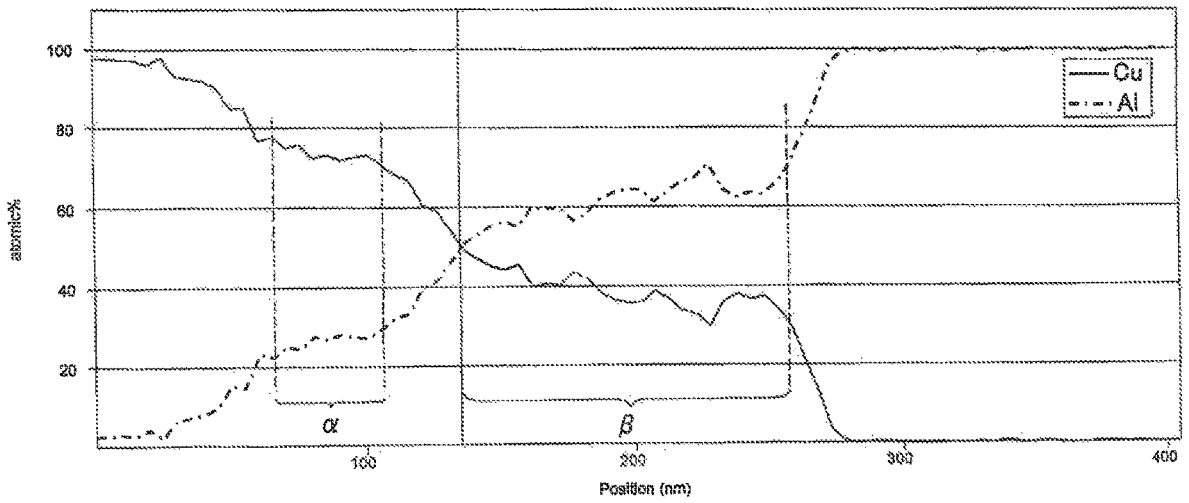
FIG. 10 is a graph showing the result of energy dispersive X-ray (EDX) analysis (linear analysis) of a sliding member of Example 1.

FIG. 10 is a graph showing the result of energy dispersive X-ray (EDX) analysis (linear analysis) of the vicinity of the boundary interface between the base substrate and the copper portion of the sliding member of Example 1.

Since, according to FIG. 10, the ratio between copper and aluminum in the α part was approximately Cu:Al=9:4 (atomic ratio), therefore it is believed that an intermetallic compound layer of $Cu_9Al_4$ was formed. Moreover since, according to FIG. 10, the ratio between copper and aluminum in the β part was approximately Cu:Al=1:2 (atomic ratio), therefore it is believed that an intermetallic compound layer of $CuAl_2$ was formed. In each of the regions including the α part and the β part, regions in which the contrast was uniform were observed in the HAADF images.

Figure 11:
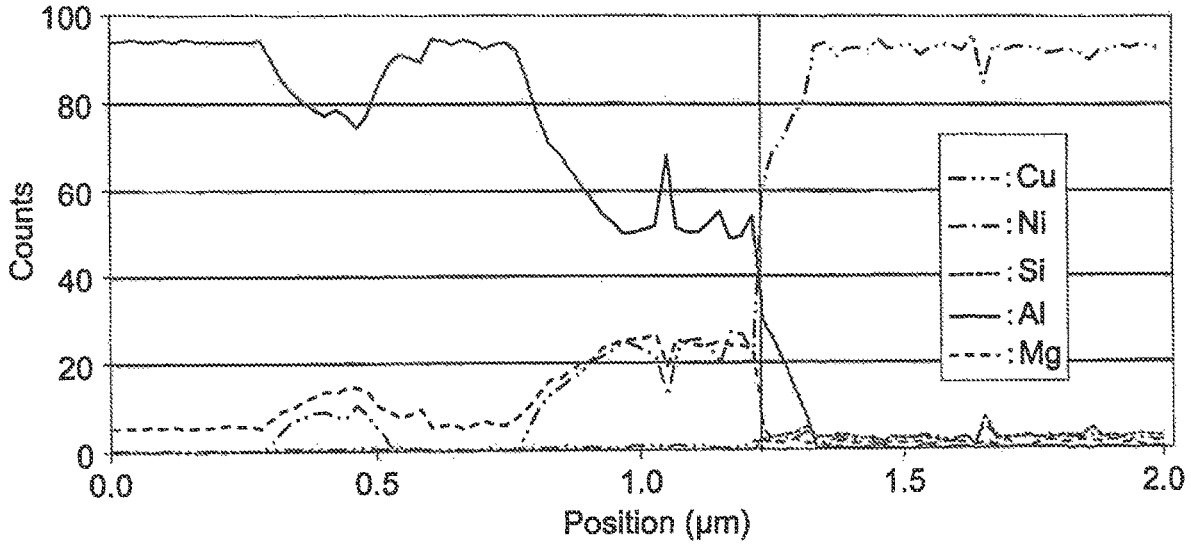
FIG. 11 is a graph showing the result of energy dispersive X-ray (EDX) analysis of a sliding member of Example 3.

FIG. 11 is a graph showing the result of energy dispersive X-ray (EDX) analysis (linear analysis) of the vicinity of the boundary interface between the base substrate and the copper alloy portion of the sliding member of Example 3.

According to FIG. 11, it will be understood that an interface layer is formed between the base substrate and the coating layer. And it will be understood that this interface layer is formed at a position from around 0.75 μm to around 1.31 μm. Furthermore, it will be understood that a diffusion layer is formed at a position from around 0.75 μm to around 0.96 μm and at a position from around 1.23 μm to around 1.31 μm. Moreover, it will be understood that the composition of the diffusion layer has a graduated structure. Yet further, it will be understood that, at a position from around 0.96 μm to around 1.23 μm, the ratio between aluminum, magnesium and copper are around Al:Mg:Cu=2:1:1 (atomic ratios), so that an intermetallic compound layer is formed.

Performance Evaluation

The following various types of performance were evaluated, employing the sliding members of each of Examples described above.

Wear Resistance

The amounts of wear were measured and calculated under the test conditions described below by employing a valve seat wear tester made by Takachiho Instrument Co. Ltd. Specifically, the shapes of the engine valve seat portions in the cylinder head before testing and after testing were acquired by employing a shape measurement device, the wear amounts at four sites were measured, their average value was calculated, and this average value was taken as being the wear amount. The results obtained are shown in Table 1 and Table 2.

The Test Conditions

Valve material for the mating member: SUH35;

Test temperature: 300° C. (with the engine valve seat portion being assumed to be on the exhaust port side of the cylinder head);

Numbers of Test: 3000 times/min. for 180 minutes.

Thermal Conductivity

The thermal conductivity was measured and calculated by the laser flash method, and the thermal conductivity was thus evaluated. The results obtained are shown in Table 1 and Table 2.

From Table 1 and Table 2, it will be understood that, with Example 1 to Example 3 which come within the scope of the present invention, the wear amount has a tendency to be lower, as compared with Comparative Example 1 to Comparative Example 4 which are outside the scope of the present invention.

In other words since, as compared with the sliding members of Comparative Example 1 to Comparative Example 4 which have coating layers obtained by performing sintering processing, the sliding members of Example 1 to Example 3 are sliding members that have predetermined inorganic portions and predetermined metal portion, or predetermined hard material portions and predetermined soft material portions, with their portions being bonded together via the interfaces, and since an interface layer that includes at least one of a diffusion layer and an intermetallic compound layer is provided at least in a portion of one of the interface between the base substrate and the coating layer and the interface between the portions, with the thickness of that interface layer being 2 μm or less, accordingly they have excellent wear resistance and excellent thermal conductivity.

Furthermore it will be understood that, as compared with a sliding member having a coating layer obtained by sintering processing, it is possible to implement excellent wear resistance and excellent thermal conductivity, even if the proportional content of the inorganic particles is low.

Moreover the fact that sliding members having excellent wear resistance such as in the cases of Example 1 and Example 2 are obtained is also considered to be because austenitic stainless steel is included as the other iron base alloy included in the metal portions.

Yet further, the fact that a sliding member having excellent wear resistance is obtained in the case of Example 1 is also considered to be because the Young's modulus of the predetermined inorganic portion is 100 GPa or greater.

Still further, the fact that sliding members having excellent wear resistance such as in the cases of Example 1 to Example 3 are obtained is also considered to be because at least one of the base substrate and the coating layer includes a plastically deformed portion.

Even further, the fact that sliding members having excellent wear resistance such as in the cases of Example 1 to Example 3 are obtained is also considered to be because, in the above described methods of manufacturing the sliding members, a process is included of forming a coating layer upon the base substrate by spraying the mixture in a non-melted state upon the base substrate.

Moreover, the fact that sliding members having excellent wear resistance such as in the cases of Example 1 to Example 3 are obtained is also considered to be because the above described mixture is sprayed upon the base substrate at such a speed that a plastically deformed portion is formed on at least one of the base substrate and the coating layer.

Furthermore, the fact that a sliding member having excellent wear resistance is obtained in the case of Example 3 is also considered to be because, as the inorganic particles that are employed as the raw material described above, inorganic particles are employed for which the ratio of the Young's modulus of the inorganic portion to the Young's modulus of the inorganic particles becomes 1.5 or greater. In other words it is considered that, in the case of Example 3, a sliding member having excellent wear resistance is obtained due to the fact that it is possible to form the coating layer with good efficiency by employing inorganic particles that are easily deformed and whose Young's modulus is 58.9 GPa, whereas in the state in which the inorganic portion has been formed the Young's modulus is 204 GPa. This change in the Young's modulus is considered to be due to the fact that the predetermined mixture described above is sprayed upon the base substrate at such a speed that a plastically deformed portion is formed on at least one of the base substrate and the coating layer.

It will also be understood that the sliding member of Example 3 is excellent with regard to thermal conductivity. Here since, as compared with the Comparative Examples that are obtained by sintering processing, diffusion is suppressed with the various Examples including Example 3, so that reduction of the thermal conductivity due to different elements being in a solid solution is avoided, accordingly it goes without saying that it is possible for both high wear resistance and high thermal conductivity are obtained.

Although the present invention has been explained above in terms of various embodiments and Examples, the present invention is not to be considered as being limited thereby; various modifications are possible without departing from the scope of the present invention.

For example, the structures and elements described in the various embodiments and Examples above are not to be considered as being limited to each of the embodiments and each of the Examples; for example, the details of the specifications of the various types of particle and the details of the conditions for layer formation may be changed, and the structures and elements of the various embodiments and Examples described above may be combined in manners other than those shown in the various embodiments and Examples.

REFERENCE SIGNS LIST

1, 2: Sliding member
10: Base substrate
10*b*: Plastically deformed portion
11: Interface layer
20: Coating layer
20*a*, 20*b*: Plastically deformed portion
20*c*: Pore
21: inorganic portion
21A: Hard material portion
22: Interface layer
23: Metal portion
23A: Soft material portion
24: Interface layer
40: Cam lobe
41: Valve lifter
42: Valve spring
43: Engine valve
43A: Valve stem
43*a*: Sliding surface
43B: Valve face
43*b*: Sliding surface
44: Stem seal
45: Valve guide
45*a*: Sliding surface
46: Cylinder head
46A: Seat portion
46*a*: Sliding surface
47: Exhaust port
48: Retainer
49: Cotter
60: Connection rod
60A: Big end portion
61: Crank pin
62: Bearing metal
62*a*: Sliding surface

The invention claimed is:

1. A sliding member comprising a base substrate and a coating layer formed upon the base substrate, wherein the coating layer comprises an inorganic portion derived from at least one type of inorganic particles selected from the group consisting of cobalt base alloy particles, chromium base alloy particles, nickel base alloy particles, molybdenum base alloy particles, or ceramic particles, and a metal portion derived from at least one type of metal particles selected from the group consisting of iron base alloy particles, copper particles, or copper alloy particles, with the inorganic portion and the metal portion being bonded together via an interface;

the sliding member includes an interface layer including at least one of a diffusion layer or an intermetallic compound layer on both of an interface between the base substrate and the coating layer and an interface between the inorganic portion and the metal portion; and the thickness of the interface layer is 2 μm or less.

2. The sliding member according to claim 1, wherein the Vickers hardness of the inorganic portion is 500 HV or greater and 1500 HV or less.

3. The sliding member according to claim 1, wherein the Vickers hardness of the metal portion is less than 500 HV.

4. The sliding member according to claim 1, wherein the iron base alloy particles include austenitic stainless steel particles.

5. The sliding member according to claim 1, wherein the Young's modulus of the inorganic portion is 100 GPa or greater.

6. The sliding member according to claim 1, wherein at least one of the base substrate or the coating layer includes a plastically deformed portion.

7. A sliding member of an internal combustion engine having a sliding member, comprising a sliding member upon a sliding region of the internal combustion engine, the sliding member comprising;

a base substrate and a coating layer formed upon the base substrate, wherein the coating layer comprises an inorganic portion derived from at least one type of inorganic particles selected from the group consisting of cobalt base alloy particles, chromium base alloy particles, nickel base alloy particles, molybdenum base alloy particles, or ceramic particles, and a metal portion derived from at least one type of metal particles selected from the group consisting of iron base alloy particles, copper particles, or copper alloy particles, with the inorganic portion and the metal portion being bonded together via an interface;

the sliding member includes an interface layer including at least one of a diffusion layer or an intermetallic compound layer on both of an interface between the base substrate and the coating layer and an interface between the inorganic portion and the metal portion; and the thickness of the interface layer is 2 μm or less.

8. The sliding member according to claim 1, wherein the coating layer comprises: the inorganic portion derived from the inorganic particles including cobalt base alloy particles and/or nickel base alloy particles, and the metal portion derived from either of austenitic stainless steel particles and copper particles, or metal particles including a precipitation hardening type copper alloy particles.

9. The sliding member according to claim 1, wherein the thickness of the interface layer is 0.2 μm to 2 μm.

10. The sliding member according to claim 7, wherein the thickness of the interface layer is 0.2 μm to 2 μm.

* * * * *